US007762860B2

(12) United States Patent
Reed

(10) Patent No.: US 7,762,860 B2
(45) Date of Patent: Jul. 27, 2010

(54) SMALL OBJECT FLOTATION DEVICE

(76) Inventor: Jennifer Reed, 8042 W. Glen Rd., Norfolk, VA (US) 23505

( * ) Notice: Subject to any disclaimer, the term of this patent is extended or adjusted under 35 U.S.C. 154(b) by 0 days.

(21) Appl. No.: 12/237,221

(22) Filed: Sep. 24, 2008

(65) Prior Publication Data

US 2009/0093177 A1 Apr. 9, 2009

Related U.S. Application Data

(60) Provisional application No. 60/977,337, filed on Oct. 3, 2007.

(51) Int. Cl.
*B63B 22/18* (2006.01)

(52) U.S. Cl. ..... 441/23

(58) Field of Classification Search ..... 441/1, 441/6, 23, 136; D16/339
See application file for complete search history.

(56) References Cited

U.S. PATENT DOCUMENTS

| | | | | | |
|---|---|---|---|---|---|
| 2,572,676 | A * | 10/1951 | Swyers | 441/6 |
| 5,000,482 | A * | 3/1991 | Cimino | 441/6 |
| 5,019,000 | A * | 5/1991 | Stephens | 441/6 |
| D327,697 | S * | 7/1992 | Vines | D16/339 |
| D368,272 | S * | 3/1996 | Starr et al. | D16/339 |
| 6,332,819 | B1 * | 12/2001 | Emmons | 441/1 |
| 6,726,516 | B2 * | 4/2004 | Sowry et al. | 441/1 |

* cited by examiner

*Primary Examiner*—Lars A Olson
(74) *Attorney, Agent, or Firm*—James A. Italia; Italia IP

(57) ABSTRACT

A flotation device for attachment to a small object to prevent the object from sinking if it is dropped into a body of liquid and for allowing the user to quickly and easily retrieve it. The device comprises a float formed of buoyant material and having a longitudinally oriented opening therethrough, a lanyard having its free ends attached together and fixed within said opening so as to form a loop portion about the float, and a spring-biased clip attached to the loop and attachable to the object to be prevented from sinking in a pool of liquid.

2 Claims, 3 Drawing Sheets

SMALL OBJECT FLOTATION DEVICE

CROSS-REFERENCE TO RELATED APPLICATION

This application claims the benefit of the filing date under 35 USC 119(e) of the filing date of U.S. Provisional Application Ser. No. 60/977,337, filed Oct. 3, 2007, the contents of which are incorporated herein by reference.

BACKGROUND OF THE INVENTION

This invention relates to a device for keeping small objects afloat. It has particular application in boating and other water-related activities, as well as in situations where a user is working in the vicinity of reservoirs of liquid.

SUMMARY OF THE INVENTION

Loss of an object into a body of water while boating, participating in water sports, or working is a frustrating experience. So, too, is inadvertently dropping an object into a large container of liquid. The present invention provides a means for preventing an item that has been so dropped from sinking and for allowing the user to swiftly and easily retrieve it. The invention also provides a means for the user to attach the object to his or her person or to a structural member.

According to the invention, a small buoyant cell is attached by means of a lanyard, cord, or the like to a releasable clip, which in turn is attached to the object that is to be protected from sinking. Likely objects are keys, eyeglasses, knives, jewelry, instruments and other small items that typically are utilized when boating or carrying out other activities in or near a body of water or a container filled with liquid. Several of the devices can be attached to a single object that is so heavy as to overcome the buoyancy of a single device.

More particularly, the present application discloses a flotation device for preventing a small object from sinking in a body of liquid and for facilitating its retrieval, said device comprising: a buoyant float; a passage extending through said float; a lanyard passing through said passage and having two free ends attached together and fixed in position within said passage so as to form a loop portion about said float; and, a releasable fastening clip attached to said loop portion and attachable to said small object.

The present application further discloses, a flotation device for preventing a small object from sinking in a body of liquid and for facilitating its retrieval, said device comprising: an elongated buoyant closed cell foam float having a scalloped outer surface; a passage through said float along the longitudinal axis thereof; a braided cord lanyard passing through said passage and having two free ends each wrapped with a tie and attached together within said passage by a split ring fixedly installed within said passage, said lanyard forming a loop portion about said float; and; a carabiner clip attached to said loop portion and attachable to said small object.

BRIEF DESCRIPTION OF THE DRAWINGS

The drawings, when considered in conjunction with the following description, are presented for the purpose of facilitating an understanding of the invention sought to be protected.

DETAILED DESCRIPTION

Figure 1:
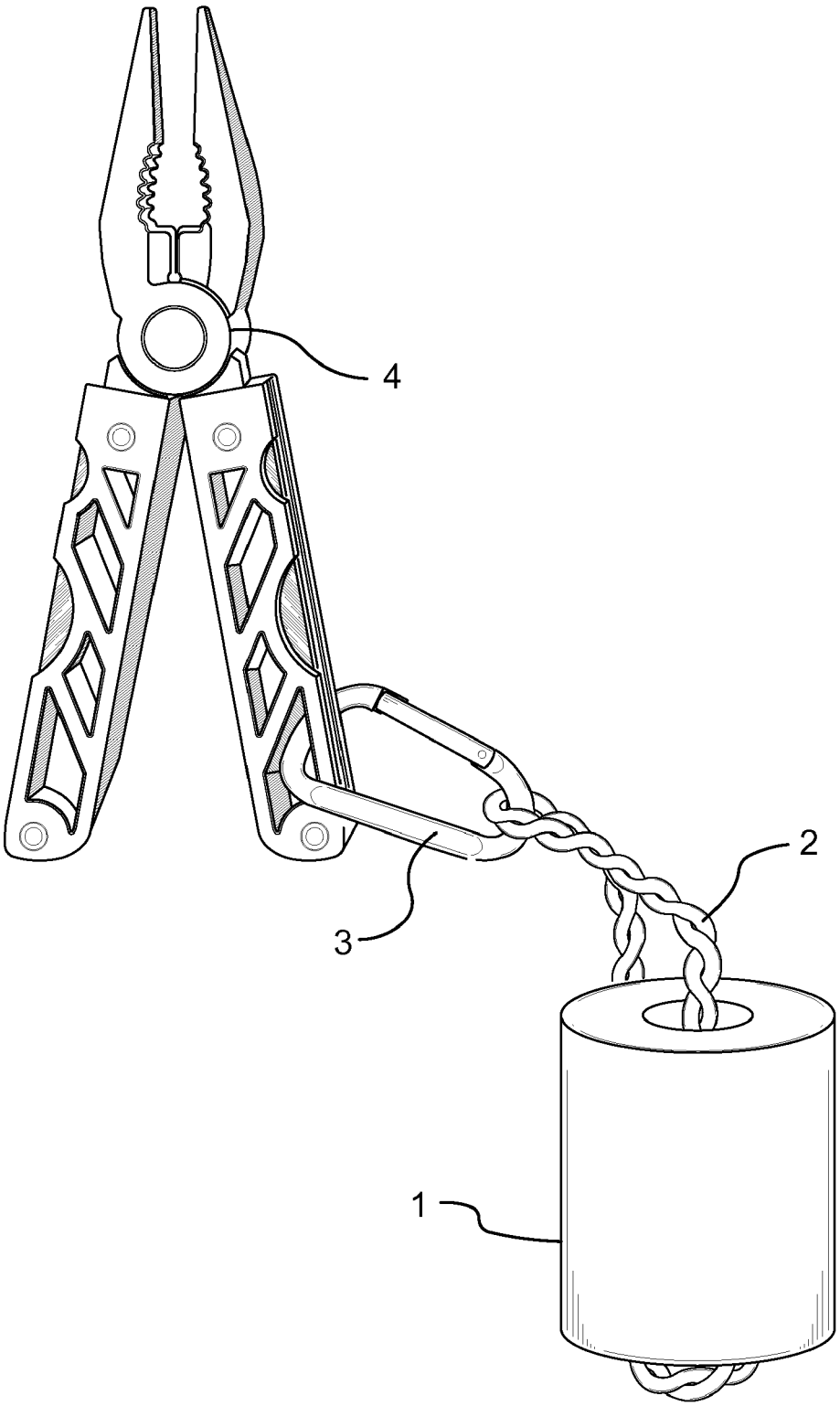
FIG. 1 is a perspective view of an embodiment of the small object flotation device of the invention attached to an item to be protected from sinking in a liquid.

FIG. 1 shows the arrangement of the major components of an embodiment of this invention. The device comprises a buoyant float 1, a lanyard 2, and a releasable carabiner clip 3. The object to be protected, which as shown is a combination tool 4, is attached to the flotation device by means of carabiner clip 3.

Figure 2:
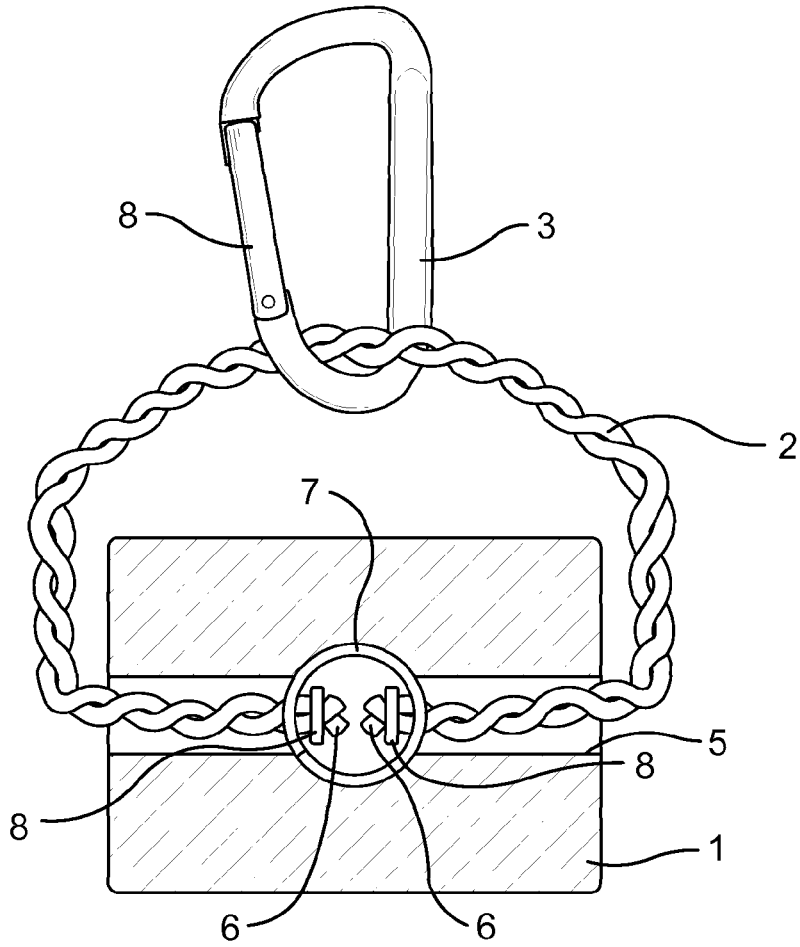
FIG. 2 is a side view of the small object flotation device of the invention, showing the buoyant cell in section.
Figure 3:
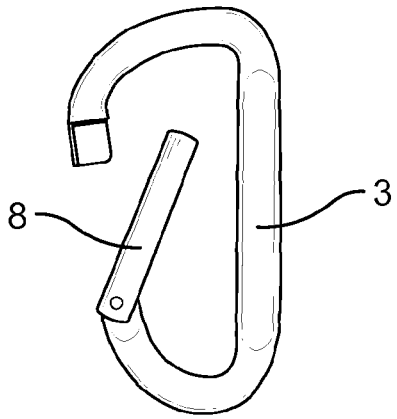
FIG. 3 is a side view of the carabiner clip of the invention in the open position.

Float 1 is depicted in FIG. 2 as being in the shape of a cylinder, and is provided with a longitudinal passage 5 extending from end to end along its longitudinal axis. Float 1 can be made of closed cell foam or other material that provides the required buoyancy while being strong and easily grasped with the user's hand. The float also may be of hollow or partially hollow construction, including balloon-like structures. The material from which float 1 is made advantageously is selected for its properties of durability and flotation, and its surface properties should facilitate secure grasping by the user even when it is wet.

Figure 4:
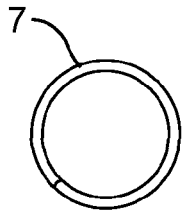
FIG. 4 is a front view of the split ring of the invention which attaches together the ends of the lanyard.
Figure 5:
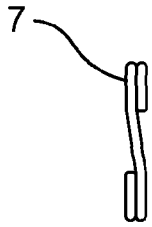
FIG. 5 is a side view of the split ring of FIG. 4.
Figure 6:
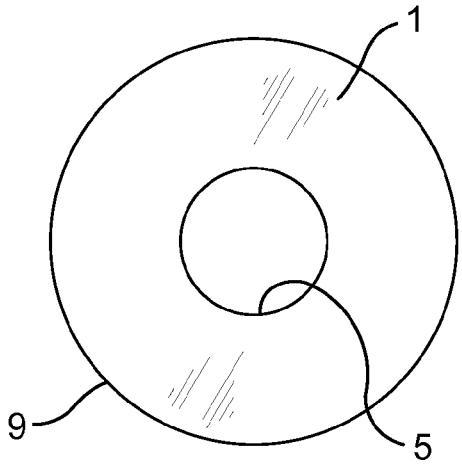
FIG. 6 is an end view of a buoyant cell of the invention having a circular cross-section.
Figure 7:
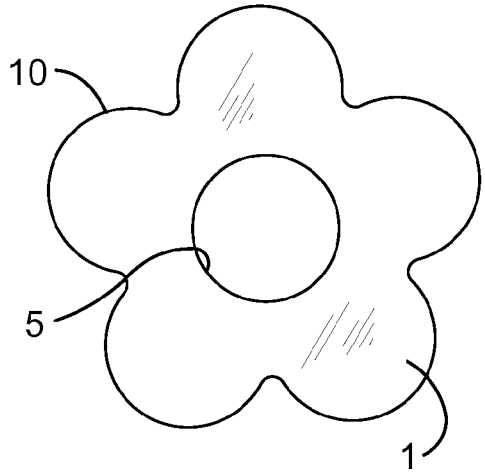
FIG. 7 is an end view of a buoyant cell of the invention having a scalloped cross-section.
Figure 8:
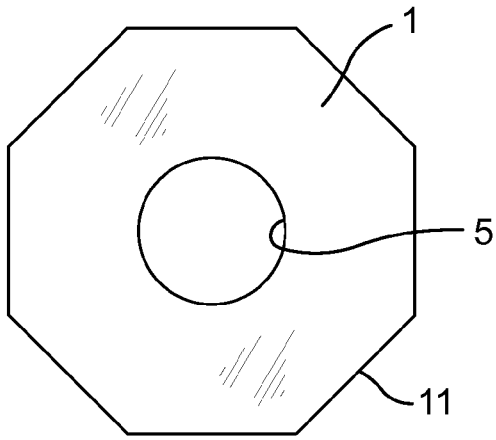
FIG. 8 is an end view of a buoyant cell of the invention having an octagonal cross-section.

Various alternative surface configurations for float 1 are shown in FIGS. 6, 7 and 8. In FIG. 6 float 1 is a right cylinder with a substantially smooth outer surface 9. It is apparent from FIG. 7 that float 1 has a scalloped surface 10, while that of FIG. 8 conforms with the octagonal cross-section 11. The non-circular shapes of FIGS. 7 and 8 provide surfaces which offer the advantage of providing a better grip for the user's hand, especially when the surfaces are wet, as can be expected to be the case in the environments in which this device is used. A further advantage is that they will cause the float to resist rolling when placed on tilted or curved surfaces As shown in FIG. 2, lanyard 2 comprises a braided cord which can be of fixed length or stretchable, such as bungee cord. The free ends 6 of lanyard 2 are placed in opposed relationship to one another and are attached together by means of a split ring 7, which is shown in a front elevation in FIG. 4 and a side elevation in FIG. 5. Ties 8 are wrapped around free ends 6 to insure that they do not unravel and are securely grasped by split ring 7. The point of attachment of free ends 6 is located within the confines of longitudinal passage 5 for protection from external forces that might otherwise cause the attachment to be compromised. To accomplish this, split ring 7 is fitted into passage 5 to fix it in place. Lanyard 2 thus is formed into a loop about float 1. Alternative lanyard types may be utilized, such as web strips with or without hook and loop fasteners, solid cords, wire, and chain. The loop created in lanyard 2 also can be placed about the user's wrist, for example, or hung upon a hook or the like, to keep the object readily accessible before use, as well as to keep it from being inadvertently dropped into the body of water or the container of liquid as it is being handled by the user.

Carabiner clip 3 is installed upon the loop portion of lanyard 2. It has a spring-loaded inwardly swinging gate 8.

Pressing gate 8 against a suitably shaped portion of the object to be protected allows it to be attached to the inventive device quickly and easily. Once attached, the inwardly swinging gate assures that the article remains attached until specific action is taken by the user. Alternative attachment means such as alligator clips and various types of closable hooks also can be used to fasten lanyard 2 to the object to be protected, In use, the disclosed device is attached to the object to be protected by means of carabiner clip 3. If the object to be protected falls into the liquid, the buoyancy of float 1 will keep it from sinking beneath the surface, and float 1 and lanyard 2 provide effective grasping means for the user to retrieve it.

While the present disclosure has been described in connection with what is believed to be effective and preferred embodiments, it is to be understood that the invention is not to be limited to the disclosed arrangements, but is intended to cover various arrangements which are included within the spirit and scope of the broadest possible interpretation of the appended claims so as to encompass all modifications and equivalent arrangements.

I claim:

1. A flotation device for preventing a small object from sinking in a body of liquid and for facilitating its retrieval, said device comprising:

a buoyant float, wherein said float is of generally cylindrically shaped closed cell foam, and a passage extends longitudinally therethrough;

said passage extending through said float;

a lanyard passing through said passage and having two free ends attached together and fixed in position within said passage so as to form a loop portion about said float;

a releasable fastening clip attached to said loop portion and attachable to said small object; and, a split ring fixed in said passage and attaching together said free ends of said lanyard.

2. A flotation device for preventing a small object from sinking in a body of liquid and for facilitating its retrieval, said device comprising:

an elongated buoyant closed cell foam float having a scalloped outer surface;

a passage through said float along the longitudinal axis thereof;

a braided cord lanyard passing through said passage and having two free ends each wrapped with a tie and attached together within said passage by a split ring fixedly installed within said passage, said lanyard forming a loop portion about said float;

and;

a carabiner clip attached to said loop portion and attachable to said small object.

* * * * *